United States Patent [19]

Jentzsch et al.

[11] Patent Number: 5,060,568

[45] Date of Patent: Oct. 29, 1991

[54] DISTRIBUTING ROLLER UNIT AND PRINTING MECHANISM PROVIDED THEREWITH

[75] Inventors: Arndt Jentzsch; Wolfgang Müller; Horst Sachers, Hans Johne; Guenter Schumann all of Coswig, German Democratic Rep.

[73] Assignee: VEB Kombinat Polygraph "Werner Lamberz" Leipzig, Leipzig, Fed. Rep. of Germany

[21] Appl. No.: 763,361

[22] Filed: Aug. 7, 1985

Related U.S. Application Data

[63] Continuation-in-part of Ser. No. 590,875, Mar. 19, 1984, abandoned, which is a continuation of Ser. No. 367,963, Apr. 13, 1982, abandoned, which is a continuation-in-part of Ser. No. 352,845, Feb. 26, 1982, abandoned.

[30] Foreign Application Priority Data

Feb. 26, 1981 [DD] German Democratic Rep. ... 227887

[51] Int. Cl.[5] ..... B41F 7/26; B41F 7/40; B41F 31/34

[52] U.S. Cl. ..... 101/148; 101/349; 101/DIG. 38

[58] Field of Search ..... 101/148, 349, 350, DIG. 14, 101/DIG. 38, 348, 205, 206, 207, 208, 209, 351, 352

[56] References Cited

U.S. PATENT DOCUMENTS

| | | | |
|---|---|---|---|
| 3,443,516 | 5/1969 | Schnall | 101/218 |
| 3,673,959 | 7/1972 | Jezuit | 101/148 |
| 3,701,316 | 10/1972 | Sylvester | 101/148 |
| 3,749,011 | 7/1973 | Abendroth | 101/148 |
| 3,757,689 | 9/1973 | Koch | 101/148 |
| 3,842,735 | 10/1974 | Southam et al. | 101/148 X |
| 3,911,815 | 10/1975 | Banfer | 101/148 |
| 3,926,116 | 12/1975 | Wildeman | 101/148 |
| 4,351,236 | 9/1982 | Beisel | 101/148 |
| 4,385,559 | 5/1983 | Jarach | 101/DIG. 14 |

FOREIGN PATENT DOCUMENTS

| | | | |
|---|---|---|---|
| 0000689 | 2/1979 | European Pat. Off. | 101/148 |
| 2077660 | 12/1981 | United Kingdom | 101/148 |

*Primary Examiner*—J. Reed Fisher
*Attorney, Agent, or Firm*—Michael J. Striker

[57] ABSTRACT

A printing mechanism and a distributing roller unit thereof has an inking roller, a dampening roller, a distributing roller located between the inking roller and dampening roller and movable between at least two positions in which it becomes alternately associated with the inking roller and the dampening roller and axially displaceable relative to the inking roller and the dampening roller, respectively, and elements for moving the distributing roller between the two positions and axially displacing the same.

5 Claims, 4 Drawing Sheets

DISTRIBUTING ROLLER UNIT AND PRINTING MECHANISM PROVIDED THEREWITH

CROSS-REFERENCE TO RELATED APPLICATIONS

This application is a continuation-in-part of application Ser. No. 590,875, filed Mar. 19, 1984, now abandoned, which is in turn a continuation of Ser. No. 367,963, filed Apr. 13, 1982, now abandoned, which is in turn a continuation-in-part of application Ser. No. 352,845, filed Feb. 26, 1982, now abandoned.

BACKGROUND OF THE INVENTION

The present invention relates to a distributing roller unit and a printing mechanism provided therewith.

Printing machines having inking rollers, dampening rollers and distributing rollers are widely known. German Offenlegungsschrift 2,845,932 discloses an offset printing mechanism having a combined inking and dampening mechanism with a friction-driven axially movable intermediate roller which connects the inking and dampening mechanism in a unit. In this construction, the intermediate roller is arranged fixedly. This possesses considerable disadvantages in the fact that, because of the fixed arrangement of the intermediate roller, its switching can be performed only in connection with the inking rollers, whereby an optimal removal of interference screens from inking and damping interference stencils cannot be differentially performed.

The screening stenciling is a phenomenon when the formation of one point of the printing form takes place at a location which is different from the location desired and lies in a circumferential direction at an application roller projection behind the first point. In other words, the printing plate includes printing and non-printing surface portions, wherein from the non-printing surface portions of the printing plate no ink is taken from the application roller and thereby an ink accumulation on the application roller takes place, which during rotation of the application roller is applied on the printing press with offset and therefore leads to undesired stripe or stencil formation. This phenomenon is increased by the plate cylinder channel, which forms a print-free zone and thereby no printing ink is taken which is then applied with offset from the application roller onto the print carrier. The above presented information with respect to the inking roller is completely applicable with respect to the dampening roller. The moisture concentration on the dampening roller leads with the printing ink to emulsification, and in some cases to ink disturbance. This phenomenon is called by experts "ghosting" or "ghost image" and identified as interference in the application. It also can be called inking and dampening interference stencils, since a certain overlapping of ink and dampening substance at not desired positions leads to the above mentioned quality failure on the printed sheets.

SUMMARY OF THE INVENTION

Accordingly, it is an object of the present invention to provide a distributing roller unit and a printing machine provided therewith in which a distributing roller has a high distributing output, is simple and inexpensive to manufacture, and improves the quality of printing by elimination of form reaction.

In keeping with these objects, and with others which will become apparent hereinafter, one feature of the present invention resides, briefly stated, in a distributing roller unit which has a distributing roller located between an inking roller and a dampening roller and movable between at least two positions in which it becomes alternately associated with the inking roller or the dampening roller, respectively, and is also axially movable relative to the inking roller and the dampening roller, and means for moving the distributing roller between these positions and displacing the distributing roller axially. A printing mechanism in accordance with the invention includes the above-described distributing roller unit.

The inventive distributing roller unit may be provided in a printing machine which has a plate cylinder on which the inking roller and the dampening roller are arranged, and the distributing roller is movable between and axially relative to the thus arranged inking and dampening rollers.

When the distributing roller unit and the printing mechanism are designed in accordance with the present invention, the distributing roller provides for high distribution output, is simple and inexpensive to manufacture, and improves the printing quality by elimination of form reaction.

The stenciling is counteracted by the adjustment of the distributing roller which can be alternately associated with the inking roller or dampening roller. The distributing roller performs additionally a changing or axial movement, whereby the ink or moisture accumulation on the application roller is eliminated in an ideal manner.

In accordance with another feature of the present invention, moving of the distributing roller between the above-mentioned two positions is carried out by rotation of a switching sleeve which has an eccentricity, and a coupling connected with the switching sleeve.

Still another feature of the present invention is that the coupling has a guide pin which is connected via a coulisse guide with a support lever mounted on an inking cylinder.

A further feature of the present invention is that the distributing roller is arranged in the coupling in a movable manner.

Finally, still a further feature of the present invention is that the contact pressure of the distributing roller on the dampening roller and/or the inking roller takes place because of the weight of the transmission elements and because of the inherent weight of the distributing roller.

Since the distributing roller in accordance with the invention has a small diameter, it performs a great number of revolutions, which provides for the advantage that an optimal effective distribution output is achieved. The construction is especially advantageous in the event of the displacement coupling of the distribution roller with the first inking cylinder, since in each switching position uniform contact force can be attained in a simple manner by weight-obtained force components. The drive of the intermediate roller in axial direction does not require any additional drive mechanisms, and thereby a possibility of additional disturbances is eliminated.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
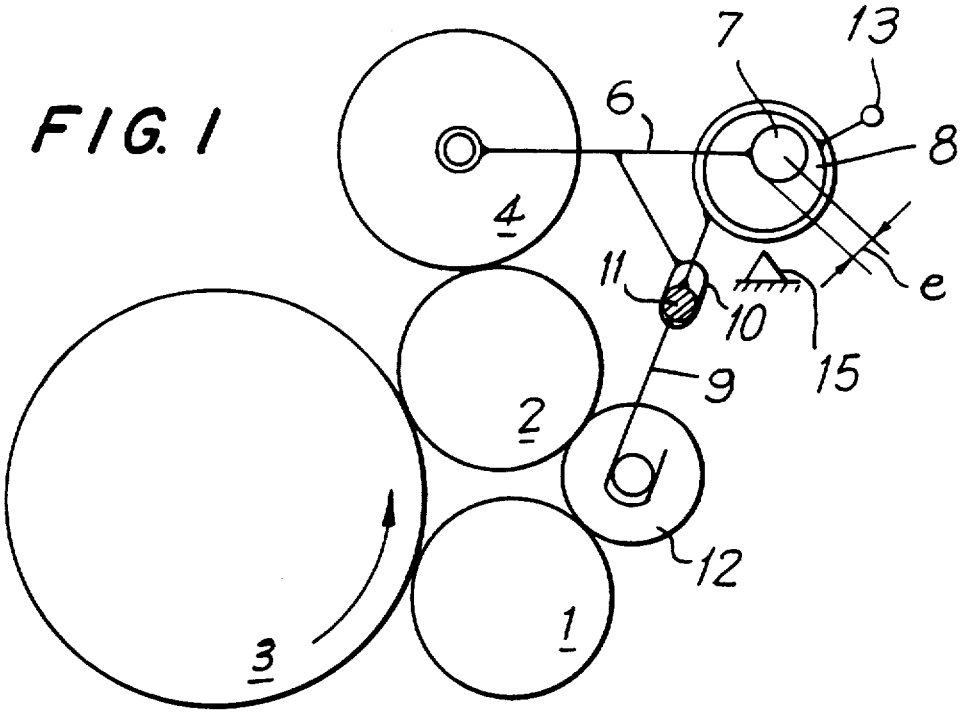
FIG. 1 is a view schematically showing a printing mechanism with a distributing roller in its one position.

A printing mechanism with a distributing roller unit in accordance with the present invention has, as shown in FIG. 1, a dampening roller 1 and an inking roller 2 contacting with a plate cylinder 3. An ink cylinder 4 is arranged on the inking roller 2.

An ink cylinder 4 has an axial core 5 fixedly connected with a radially movable support lever 6. The lever 6 is connected, for example by screwing, with a traverse 7. A switching sleeve 8 is arranged on the traverse 7 movable about its axis with an eccentricity e. The sleeve 8 carries at both its sides a coupling 9 with a guide pin 11. The guide pin 11 connects the coupling 9 and the lever 6 via a coulisse guide 10. A hexagonal nut 16 is fixedly screwed on the guide pin 11. The distributing roller 12 is displaceably supported in the guide of the coupling 9 and connects in its position I the damping and inking elements to a unit.

The axial core 5 of the ink cylinder 4 is supported axially and radially movable in a side wall 17 of the printing mechanism or the printing machine. The axial core 5 has a free end and is provided at its free end with a guide 18. A roller of a transmission lever 19 engages in the guide 18. The transmission lever 19 is turnably supported in a bearing block 20 which is mounted in the side wall 17 of the printing mechanism or the printing machine. A guiding cam 21 is turnably supported in the bearing block 20 and the side wall 17. The transmission lever 19 a free end which is provided with a roller engaging in the guiding cam 21.

The plate cylinder 3 has an axial core which is connected with the guiding cam 21. This connection is performed via a toothed wheel 22 rotatable together with the guiding cam 21, and a toothed wheel 23 rotatable together with the plate cylinder 3. The toothed wheels 22 and 23 engage one another.

The operation of the inventive printing mechanism is as follows:

The plate cylinder 3, the dampening roller 1, the inking roller 2, and the ink cylinder 4 are driven in a known manner. The ink cylinder 4 performs a rotary and translatory movement. With the aid of the lever 6 arranged on the ink cylinder 4, the axial movement is transmitted to the traverse 7 and the sleeve 8 mounted thereon to the coupling 9 which guides the distributing roller 12.

The transmission elements 6, 7, 8 and 9 guarantee a weight-loaded abutment of the distributing roller 12 on the inking roller 1 and/or dampening roller 2. The distributing roller 2 has, in addition to the axial movement a rotary movement due to friction.

Figure 2:
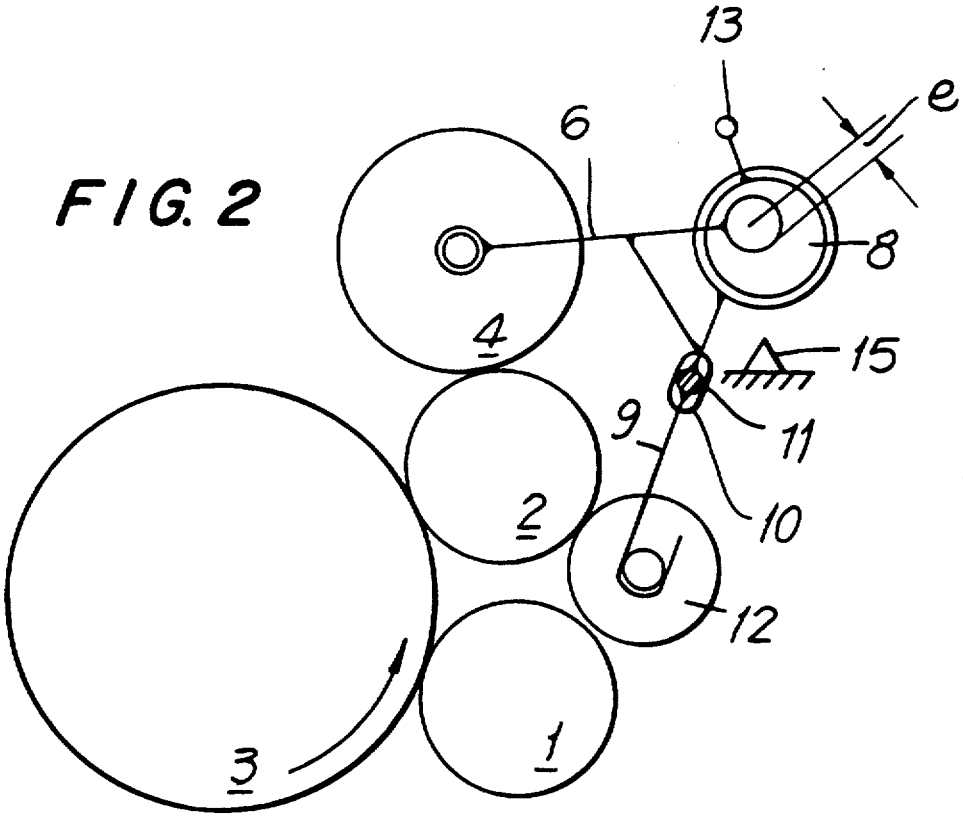
FIG. 2 is a view substantially corresponding to the view of FIG. 2, but depicting the distributing roller in another position.

When the switching sleeve 8 is turned, with preliminary release of the hexagonal nut 16, the distributing roller 12 can be displaced with the aid of a handle 13 guided in an opening 14 between the following positions. It can be displaced to a position shown in FIG. 2 in which it contacts the inking roller 2 and serves as a rider roller. It can also be displaced to a position shown in FIG. 1 in which it is located between the inking roller 1 and dampening roller 2 and serves as a connecting roller between the above-mentioned inking and dampening rollers. It can also be located in a position shown in FIG. 3 and serve as a rider roller for the dampening roller 1. After each of these displacements, the hexagonal nut 16 is again fixedly tightened.

Figure 3:
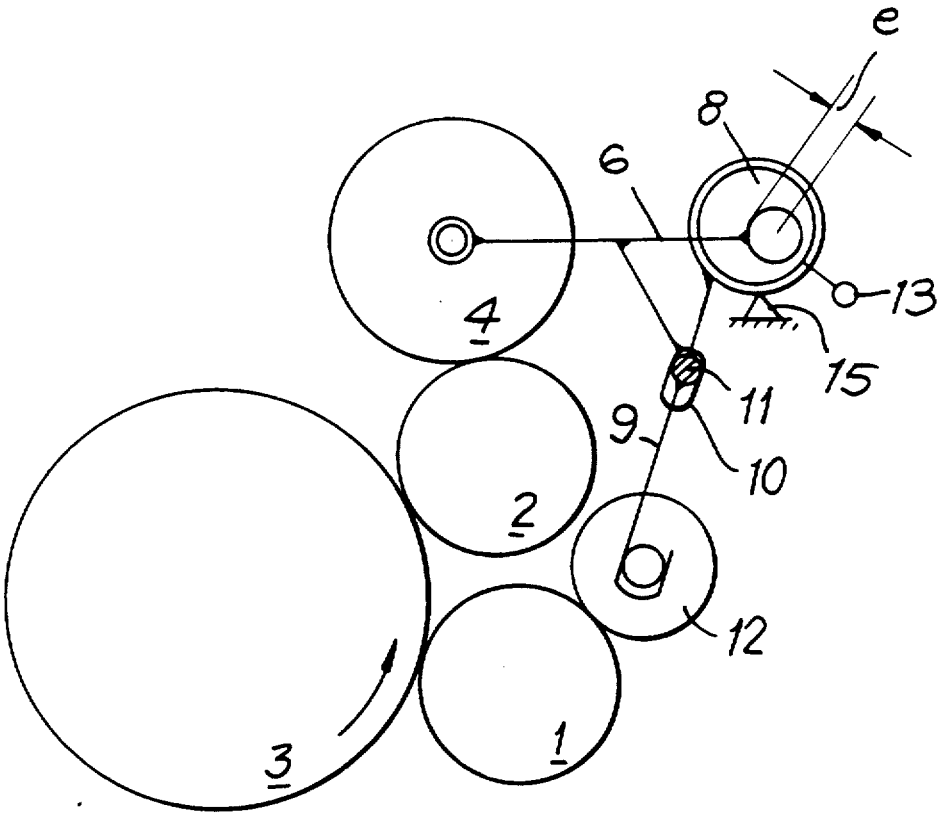
FIG. 3 is a view substantially corresponding to the views of FIGS. 1 and 2, but showing the distributing roller in a further position.

In the position shown in FIG. 3, a fixed abut 16 for the switching sleeve 8 is required, so that the inherent weight of the transmission elements 6, 7, 8 and 9 does not press the distributing roller 12 to the position of FIG. 1. A scale ring may also be provided, with the aid of which the individual positions of the distributing roller can be adjusted in a reproducible manner. This scale ring is not shown in the drawings.

Figure 4:
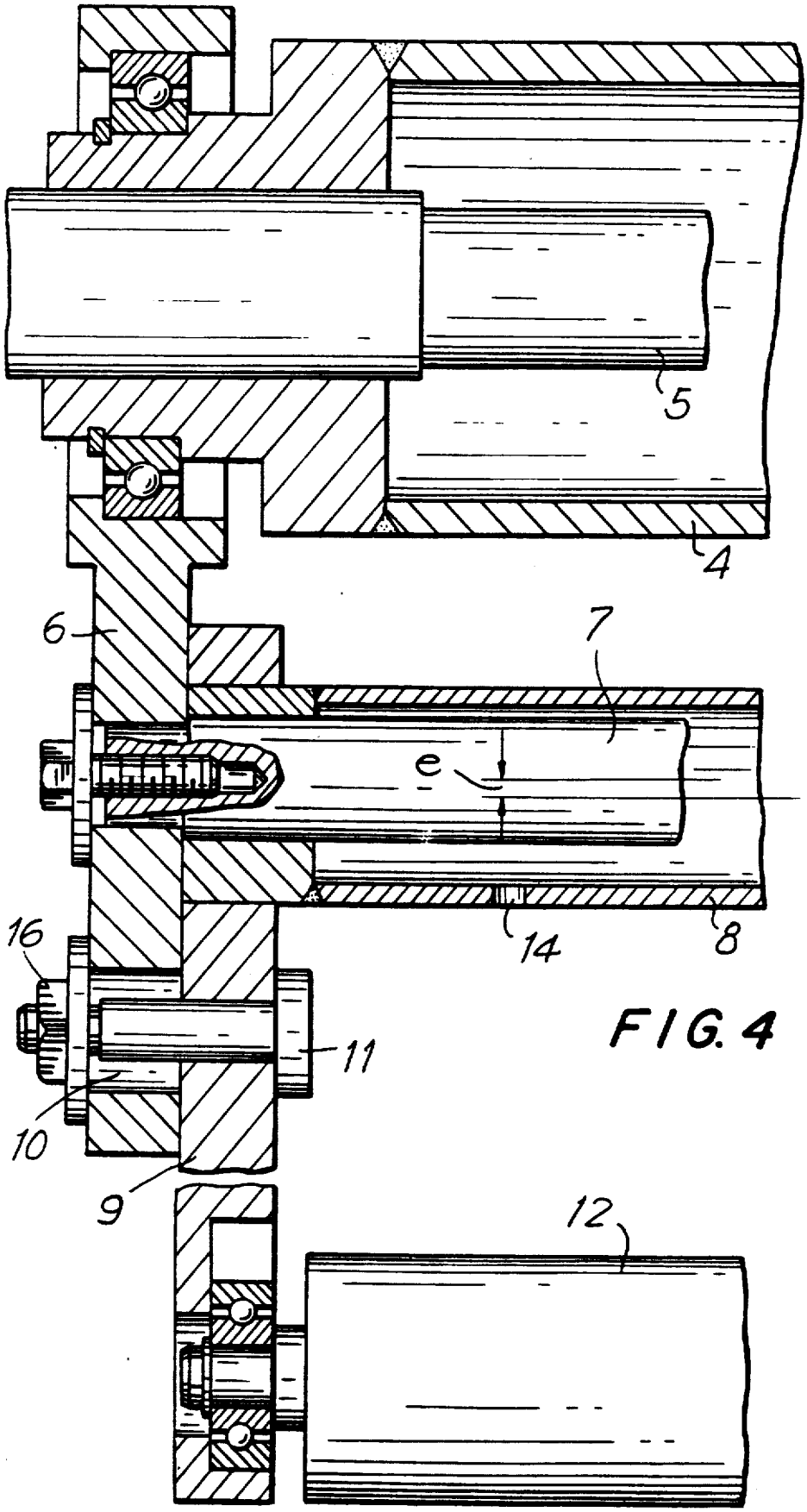
FIG. 4 is a lateral view of the printing mechanism in accordance with the present invention.
Figure 5:
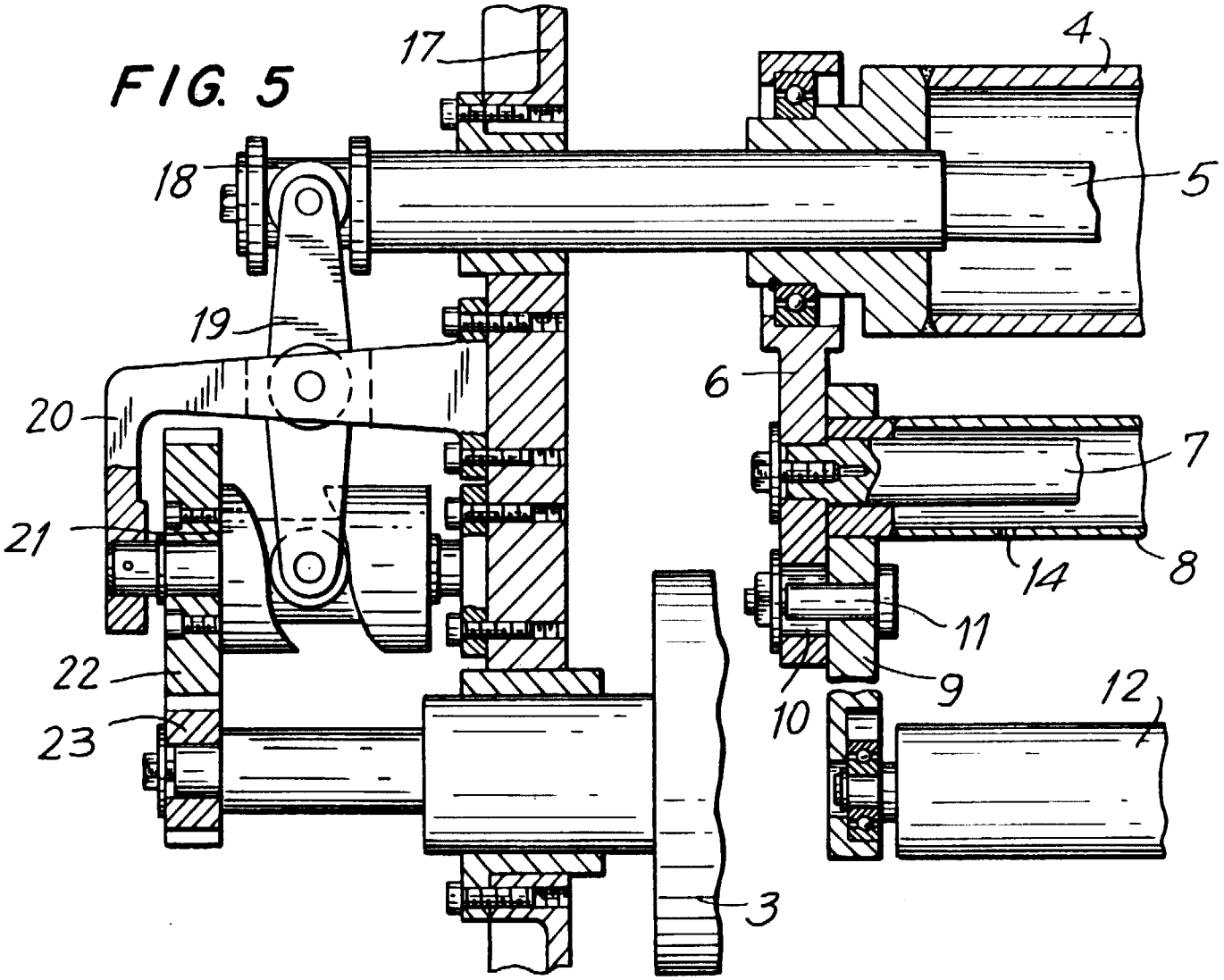
FIG. 5 is a lateral view which, in addition to the view of FIG. 4, shows means for axial movement of the distributing roller.

The plate cylinder 3 is driven from the drive of the printing machine. This rotary movement is transmitted via the toothed wheels 22 and 23 to the guiding cam 21 whereby the ink cylinder 4 is moved axially via the transmission lever 19. This axial movement of the ink cylinder 4 is transmitted via the means shown in FIG. 4 to the distributing roller 12. Thus, in all positions of the distributing roller 12 it can move axially in contact with the inking and dampening rollers.

The position I has the object of providing equilibrium between the inking and dampening rollers and to thereby stabilize the printing process without any significant waste. Moreover, when the rollers 1 and 2 are removed, the connection between the inking and dampening elements can be retained during cleaning processes for transmission of cleaning medium.

The position II counteracts the screen formation especially in the inking element and provides for distribution of dampening medium taken from the inking roller 2 via the printing plate. The position III serves for eliminating interference screens produced mainly in the dampening element.

Furthermore, the dampening medium overflow which is produced by flowing through the plate cylinder passage, is supplied or distributed on the dampening roller 1 by the distributing roller 12. In exceptional or urgent situations, the distributing roller 12 can be turned away from both rollers 1 and 2, and the abutment 15 can be displaced further upwardly by a not shown suitable means.

It will be understood that each of the elements described above, or two or more together, may also find a useful application in other types of constructions differing from the types described above.

While the invention has been illustrated and described as embodied in a printing mechanism and distributing roller thereof, it is not intended to be limited to the details shown, since various modification and structural changes may be made without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A printing mechanism, comprising an inking roller; a dampening roller; a distributing roller located between said inking roller and said dampening roller and movable between at least two positions in which it becomes alternately associated with said inking roller and said dampening roller and axially moves relative to said inking roller and said dampening roller, respectively, to thereby counteract stencil formation from said inking roller and said dampening roller, respectively; means for moving said distributing roller between said two positions; and means for axially displacing said distributing roller, said means for moving including a rotatable sleeve having an eccentricity, and a coupling connected with said distributing roller and said rotatable sleeve so that when said rotatable sleeve rotates eccentrically it displaces said coupling and thereby said distributing roller between said at least two positions.

2. A printing mechanism as defined in claim 1; and further comprising an ink cylinder associates with said inking roller and having a support lever, said coupling carrying a guide pin and having a coulisse guide connecting said guide pin with said support lever.

3. A printing mechanism as defined in claim 1, wherein said distributing roller is movably supported in said coupling.

4. A printing mechanism, comprising an inking roller; a damping roller; a distributing roller located between said inking roller and said dampening roller and movable between at least two positions in which it becomes alternately associated with said inking roller and said dampening roller and axially moves relative to said inking roller and said dampening roller, respectively, to thereby counteract stencil formation from said inking roller and said dampening roller, respectively; means for moving said distributing roller between said two positions; means for axially displacing said distributing roller; an ink cylinder contacting with said inking roller and axially displaceable; and connecting means connecting said ink cylinder with said distributing roller so that said distributing roller displaces axially in response to the axially displacement of said ink cylinder.

5. A printing mechanism as defined in claim 4, and further comprising a rotatable plate cylinder with an axially extending axle having a free end, said ink cylinder also having an axially extending axle having a free end, said connecting means including a pivotable two-arm lever with one arm connected with said free end of said axle of said ink cylinder and another arm, a cam member engaging with and displaceable by the other end of said lever, a first toothed wheel connected with said cam member, and a second toothed wheel arranged on said free end of said axle of said plate cylinder and engaging with said first toothed wheel so that said ink cylinder axially displaces in response to the rotation of said plate cylinder.

* * * * *